United States Patent [19]

Maeda et al.

[11] Patent Number: 4,692,191

[45] Date of Patent: Sep. 8, 1987

[54] METHOD OF IMPROVING FUNCTIONS OF SURFACE OF ALLOY STEEL BY MEANS OF IRRADIATION OF LASER BEAM, AND ALLOY STEEL AND STRUCTURE MADE BY THE METHOD

[75] Inventors: Shigeyoshi Maeda; Masahiro Yamamoto; Hiroyasu Omata; Hideya Okada, all of Kawasaki, Japan

[73] Assignee: Nippon Steel Corporation, Tokyo, Japan

[21] Appl. No.: 869,783

[22] Filed: Jun. 2, 1986

[30] Foreign Application Priority Data

| | | | |
|---|---|---|---|
| Jun. 4, 1985 | [JP] | Japan | 60-120967 |
| Oct. 8, 1985 | [JP] | Japan | 60-222770 |
| Mar. 8, 1986 | [JP] | Japan | 61-49543 |

[51] Int. Cl.[4] ..... C23C 22/50

[52] U.S. Cl. ..... 148/6.14 R; 148/6.2

[58] Field of Search ..... 148/6.14 R, 6.2

[56] References Cited

FOREIGN PATENT DOCUMENTS 55-82780 6/1980 Japan .

*Primary Examiner*—Sam Silverberg

*Attorney, Agent, or Firm*—Pollock, Vande Sande & Priddy

[57] ABSTRACT

A method of improving the functions of the surface of alloy steel by means of the irradiation of a laser beam is disclosed. In this method, the alloy steel is kept in contact with the aqueous solution of oxidizing acid or salt thereof and the irradiation of a laser beam is applied on the surface of the alloy steel through the aqueous solution, thereby concentrating an alloy component on the surface of the alloy steel. The aqueous solution contains at least one selected from the group consisting of nitric acid or nitrate, chromic acid or chromate, or permanganic acid or permanganate. In addition, the irradiation of the laser beam is applied so as to depict a given pattern on the surface, and a computer controls the shape and the size of the beam, the position of the alloy steel, and the like. The present method enables the improvement of a surface function of the alloy steel by providing various kinds of color-patterns.

10 Claims, 13 Drawing Figures

21 : OPENING PORTION

22 : SHIELDING PORTION

3 : PORTION OF GOLD COLOR

4 : PORTION OF GREEN COLOR

METHOD OF IMPROVING FUNCTIONS OF SURFACE OF ALLOY STEEL BY MEANS OF IRRADIATION OF LASER BEAM, AND ALLOY STEEL AND STRUCTURE MADE BY THE METHOD

BACKGROUND OF THE INVENTION

The present invention generally relates to a method of improving the functions of the surface of alloy steel so as to improve corrosion resistance, adhesion (the properties of bonding metal and organic substances), wear resistance, paintability, weldability, and the colorability of an ornamental color pattern, and the method of this invention is a novel technique which can be widely applied to various industrial fields such as the chemical industry, the machine industry, the automobile industry, and the canning industry in which alloy steel is used as a material. The present invention also relates to an alloy steel and a structure both made by the method. In particular, the present invention pertains to a method in which alloy steel is kept in contact with an aqueous solution of oxidizing acid or salt thereof, the surface of the alloy steel being irradiated with high power laser beam from the outside through the aqueous solution, and the chemical reaction thus caused on the surface being utilized to concentrate a specific component of the alloy steel on the surface thereof, thereby improving the functions of the surface of the alloy steel, and an alloy steel and a structure both made by use of the method of the present invention.

Various proposals have heretofore been made with respect to a method in which the surface of steel is irradiated with a laser beam for the purpose of improving the surface. For example, several methods are known in which the surface of steel is heated to a high temperature by the irradiation of a high-powered $CO_2$ laser beam directly on the surface of the steel, thereby effecting . the quenching of the steel or alloying of a coating metal provided on the surface of steel, or obtaining an amorphous structure of the surface by rapid heating and quenching. As an example, one of the methods is disclosed in "SURFACE TREATMENT BY USING A LASER SYSTEM," *KOGYO ZAIRYO* (industrial material) 32 (3) 31 (1984) which is written by Toshihiro Umehara.

The specification of Japanese Patent Unexamined Publication No. 116886/1981 discloses a method in which the surface of a mild steel is irradiated directly with pulse laser beam to activate the surface, thereby improving the characteristics of chemical conversion treatment.

The specification of Japanese Patent Unexamined Publication No. 82780/1980 discloses a method in which a work piece is kept in contact with a gas or a liquid containing halogenide and the surface of the work is corroded by the irradiation of a laser beam thereon, whereby metal combined with halogen (such as W, Fe or the like) is precipitated on the surface of the work.

However, these prior arts never disclose such matter that a particular constituent in the surface of an alloy steel can be concentrated by the irradiation of laser beam onto the surface.

Regarding the coloring of a chromium-containing alloy steel such as stainless steel which coloring is one of the surface functions, the specifications such as of Japanese Patent Unexamined Publication No. 120939/1976 disclose a method of coloring the chromium-containing alloy steel such as stainless steel in which an interference film is formed on the surface of stainless steel by the coloring thereof so that the color of the surface becomes any one of blue, silver, red, purple or green. However, such coloring methods upon which the prior art relies are to monochromatically color the entire surface of a steel sheet, and commonly, it has been difficult to obtain a polychrome pattern. Therefore, the industrial production of polychrome pattern stainless steel has not yet been carried out.

SUMMARY OF THE INVENTION

Accordingly, it is a primary object of the present invention to provide a method in which the surface of alloy steel is irradiated with a laser beam through a particular aqueous liquid so as to improve the functions of the surface of the alloy steel, thereby improving corrosion resistance, adhesion, wear resistance, paintability, weldability and the colorability of an ornamental color pattern.

It is another object of the invention to provide an alloy steel having improved surface function by use of the method of the invention.

It is still another object of the invention to provide a structure made of the alloy steel of the invention.

It is another object of the present invention to provide a method of improving the surface function of an alloy steel by providing a color pattern on the surface of a chromium-containing alloy steel by using a laser beam.

It is another object of the present invention to provide a method of improving the surface function of an alloy steel by providing a color pattern on the surface of a chromium-containing alloy steel by use of a laser beam, while controlling precisely the pattern and color tone with relatively easy operation.

The inventors found the phenomenon in which, when an irradiation of laser beam was applied on the surface of alloy steel which was kept in contact with an aqueous solution of oxidizing acid or salt thereof, a chemical reaction occurred which could not be foreseen from prior arts regarding the irradiation of laser beam. Specifically, a particular component was concentrated on the surface of the alloy steel disposed in an aqueous solution such as of nitric acid, chromic acid or salt thereof; for example, chromium was concentrated to a remarkable extent on the surface of stainless steel. The phenomenon of concentration is limited to a case of an oxidizing acid such as nitric acid, chromic acid, permanganic acid or the like, and it does not occur or hardly occurs in usual non-oxidizing acid such as hydrochloric acid, sulfuric acid or the like. In the same manner, a particular component was concentrated to a remarkable extent on the surface of alloy steel in the aqueous solution of the metallic salt of oxidizing acid such as nitrate.

A method of the invention for improving surface function of an alloy steel, comprising the steps of:

providing an alloy steel having a surface, providing an aqueous solution of an oxidizing acid or of a salt of said acid so that the solution is in contact with the surface of the alloy steel, irradiating the surface of the alloy steel with laser beams through said aqueous solution so that at least one particular alloy constituent of the alloy steel is concentrated in at least a part of said surface.

It is preferable that the solution of oxidizing acid or salt thereof should be aqueous solution containing at least one selected from the group consisting of nitric acid, nitrate, chromic acid, chromate, permanganic acid and permanganate.

The inventors examined by an electrochemical method the phenomenon of concentration of an alloy component on the alloy steel. It was found that an original film on the surface of the alloy steel was instantaneously broken by the irradiation of a laser beam, a new oxide film, that is, a passive film being regenerated in a short time (0.1 seconds or less) by the oxidizing effect of the solution, and that at the same time that the selective dissolution of a base material, i.e., iron was caused by an oxidizing solution, with the result that alloying constituents were concentrated in the resultant new passive film formed on the surface of the alloy.

In order to keep steel in contact with solution, methods such as dipping, spraying or coating are appropriately selected in accordance with the shape of a material to be treated (either a sheet or a strip).

An alloy steel of the invention having improved surface function, comprising:

a matrix containing chromium of 3–25 wt%, at least one optional kind selected from the group consisting of Ni of not more than 10 wt%, Ti of not more than 5 wt%, Mo of not more than 5 wt% and Si of not more than 5 wt%, and the balance iron; and a surface layer containing chromium of a weight percent more than that of the chromium existing in said alloy steel, and iron of a weight percent less than that of the iron existing in said alloy steel, and the optional component of a weight percent more than that of the optional component existing in said alloy steel, the concentration of the chromium in the surface layer being varied continuously in the range of the surface layer in a direction toward the matrix.

The thickness of the surface layer is in a range of 10–300 angstrom.

A structure of the invention having an improved surface function, comprising a substrate made of an alloy containing chromium of 3–25 wt%, at least one optional component selected from the group consisting of Ni of not more than 10 wt%, Ti of not more than 5 wt%, Mo of not more than 5 wt% and Si of not more than 5 wt%, and the balance iron, and a surface layer provided on at least a part of the surface of the substrate, said surface layer containing chromium of a weight percent more than that of the chromium existing in said substrate, and iron of a weight percent less than that of the iron existing in said substrate, and the optional component of a weight percent more than that of the optional component existing in said substrate so that the surface function of the structure is improved, the concentration of the chromium in the surface layer film being varied continuously in the range of the surface layer in a direction toward the substrate.

The thickness of the surface layer is preferably in 2 range of 10–300 angstroms.

A method of the invention for improving the surface function of an alloy steel by providing a colorpattern, comprising the steps of:

providing a chromium containing alloy steel having a surface in contact with an aqueous solution of an oxidizing acid or salt thereof;

irradiating the surface of the alloy steel with a laser beam through a mask so that both an irradiated portion and a non-irradiated portion are provided on said surface; and subjecting the surface of the alloy steel to a coloring so that said irradiated portion has a color different from that of said non-irradiated portion.

The mask is a screen having openings which allow a laser beam to pass and intercepting portions which do not allow a laser beam to pass, and is shaped in the form of a plate in which the openings and the intercepting portions are so disposed as to form a desired pattern.

A method of the invention for improving the surface function of an alloy steel by a color pattern with precise control of the pattern and color tone thereof, comprising the steps of:

providing a chromium containing alloy steel having a surface in contact with an aqueous solution of an oxidizing acid or salt thereof;

irradiating the surface with a laser beam so as to concentrate chromium in the irradiated surface while controlling an irradiation pattern, a position of irradiation and amount of irradiation by use of a computer so that irradiation power of laser beam varies in the pattern; and subjecting the irradiated surface to an coloring so that said irradiated portion has polychrome pattern due to the variation in chromium concentration.

An alloy steel sheet having color pattern of the invention, comprising a matrix containing 3–25 wt % chromium and the balance iron which matrix has an interference color, and a pattern portion provided on a part of the surface of the sheet which pattern portion contains chromium of another amount more than that of the chromium in the matrix and has another interference color different from the former interference color, said difference between said interference colors being brought about by variation in chromium concentration in surface.

The above and other objects, features and advantages of the present invention will become apparent from the following description of the preferred embodiments thereof, taken in conjunction with the accompanying drawings.

DESCRIPTION OF THE PREFERRED EMBODIMENTS

First, description will be made below of the method of improving the functions of the surface of the alloy steel of this invention, with reference to FIGS. 1A and 1B.

Figure 1A:
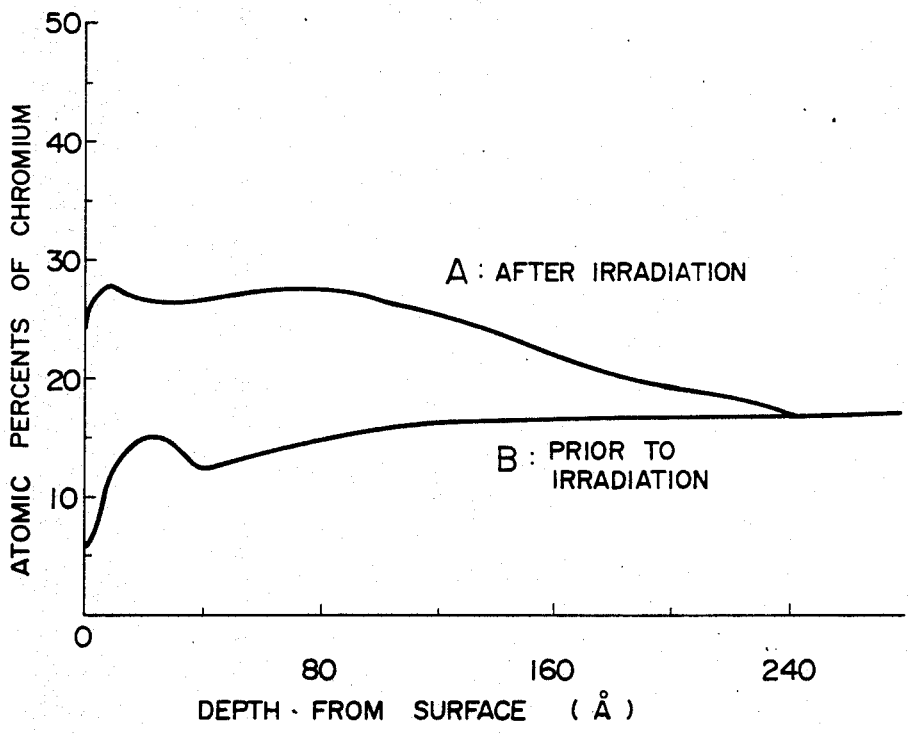
FIGS. 1A and 1B are graphs showing respectively in terms of atomic percent and weight percent the concentration profile (A) obtained from the measurement of the laser beamtreated surface of AISI 430 (17% Cr) stainless steel by Auger electron spectroscopy and the concentration profile (B) which is plotted for the sake of comparison regarding a non-treated same stainless steel.
Figure 1B:
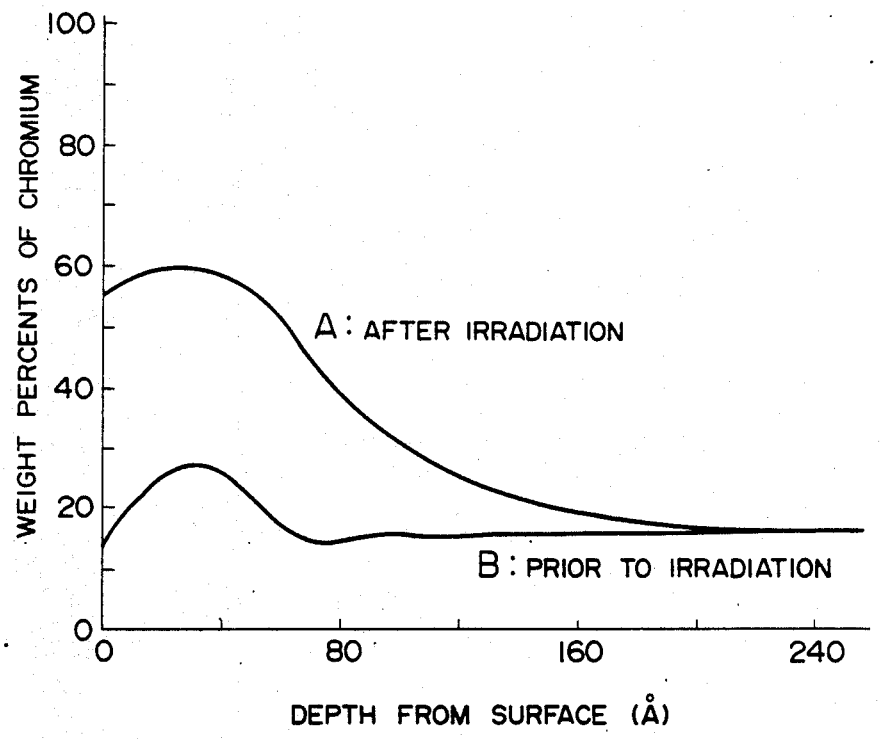

In FIGS. 1A and 1B, symbol A denotes the concentration profiles in atomic % and weight % which are obtained from the measurement of a laser beam-treated stainless steel by Auger electron spectroscopy, that is, a chromium containing stainless steel (an original sheet: AISI 430 in which the content of Cr is 17%) was dipped in an aqueous 10% nitric acid solution, and the irradiation of a laser beam (2.2 Joule, irradiating period of time: $3\times10^{-9}$ sec $\times$6 times) was applied on the surface of the steel through a glass window from the outside. Thereafter, the laser-treated steel was taken out and washed and the composition of the surface was measured by Auger electron spectroscopy (AES). For the sake of comparison, the concentration profile of the chromium stainless steel which is not treated by a laser beam is also plotted as symbol B. As shown in FIGS. 1A and 1B which shows the same phenomenon, the irradiation of a laser beam remarkably concentrates chromium on the surface of the steel, and the atomic concentration reaches approximately 28 atomic % which exceeds twice as high as the original value. Hitherto, it has been well known that the corrosion resistance of stainless steel depends upon the passive film of a thickness of 10–50 Å which is formed on the surface and the corrosion resistance is proportional to the concentration of the chromium which is contained in the passive film. Hence, the above-described result plotted in FIG. 1 shows that it is possible to convert lower chromium steel into higher chromium steel through the irradiation of a laser beam carried out in aqueous solution. In fact, although 5 to 6 wt% chromium steel is not sorted in the category of stainless steel, if the irradiation of a laser beam is applied on such chromium steel in aqueous nitric acid solution, the surface chromium concentration becomes equal to or greater than that of 13% stainless steel. As a matter of course, corrosion resistance is remarkably improved, and for example, the corrosion resistance of 17% Cr steel (AISI 430) becomes 7 to 10 times higher than that of untreated steel when evaluated on the basis of the depassivation time of a passive film in an aqueous sulfuric solution. The inventors carried out further experiments by using alloy steel having a different chromium content and by varying laser treatment conditions (a total irradiation power and the concentration of solution). It was found that corrosion resistance was directly proportional to the atomic concentration of chromium which is formed on a surface film by the irradiation of a laser beam.

Figure 2:
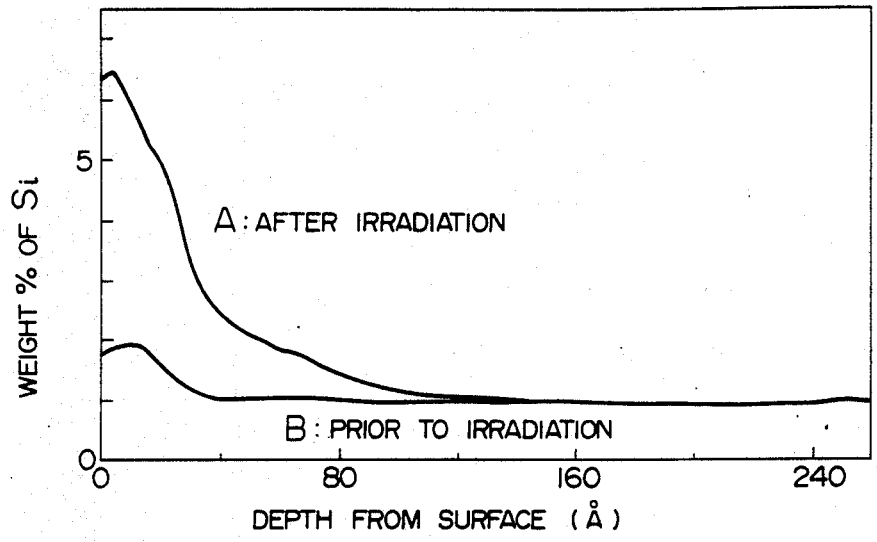
FIG. 2 is a graph showing the concentration profile (A) of the amount of Si varied from a surface in the direction of the thickness of a 1% Si alloy steel subjected to the same treatment as in FIG. 1A.
Figure 3:
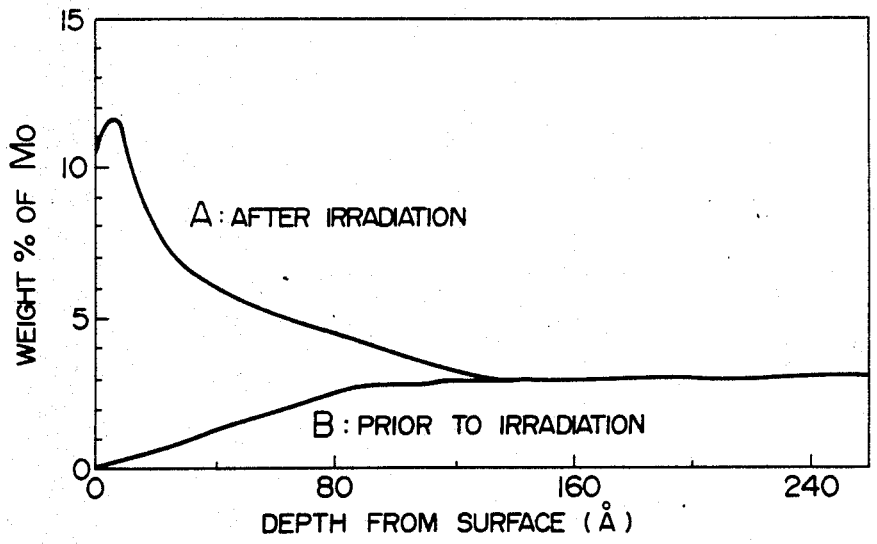
FIG. 3 is a graph showing the concentration profile (A) of the amount of Mo varied from a surface in the direction of thickness of AISI 316 stainless steel subjected to the same treatment as in FIG. 1A.

It should be noted that, in addition to chromium, nickel, titanium, molybdenum, silicon and the like are alloy elements which are concentrated on the surface of the steel by the irradiation of a laser beam, as shown for example in FIGS. 2 and 3, which FIG. 2 is a graph showing the concentration profile (A) of the amount of Si varied in the direction of the thickness of a 1% Si alloy steel subjected to the same treatment as in FIGS. 1A and 1B, which FIG. 3 is a graph showing the concentration profile (A) of the amount of Mo varied in the direction of thickness of AISI 316 stainless steel subjected to the same treatment as in FIG. 1A.

In the present invention, it is in no way necessary to specify the concentration of the above-described alloy elements in the steel and the composition thereof. For example, in a case where alloy steel having the chromium concentration of the minimum 13 wt% needs to be produced in order to obtain a sufficient corrosion resistance equivalent to that of stainless steel, the chromium concentration of the matrix of a steel may be 5 to 6 wt% so as to obtain such corrosion resistance equivalent to 13% Cr stainless steel if treated in accordance with the invention.

In the case of an original stainless steel, for example, a ferritic stainless steel such as AISI 410 (13%Cr), AISI 430 (17%Cr) and AISI 434 (18%Cr-1%Mo) or the austenitic stainless steel such as AISI 304 (18%Cr-8%Ni), AISI 316 (18%Cr- 12%Ni-2.5%Mo) and AISI 321 (18%Cr-8%Ni-Ti), not only chromium and nickel but also titanium, molybdenum and niobium are concentrated on the surface by the irradiation of laser beam, so that the laser-beam treatment is capable of further improving the original corrosion resistance of the respective steels. The alloy elements exhibiting improved corrosion resistance by surface concentration are chromium, nickel, titanium, molybdenum and so forth, and silicon is effective in improving paintability, adhesion between polymer adhesives and the steel as well as corrosion resistance.

The aqueous solution which is employed in the present invention is that of oxidizing acid or salt thereof, and normally there are three kinds. First is that of nitric acid such as nitric acid, sodium nitrate, ammonium nitrate, potassium nitrate, nitrous acid, sodium nitrite, and potassium nitrite; second is that of chromic acid such as chromic acid, ammonium chromate, sodium chromate, dichromic acid, sodium dichromate and ammonium dichromate; and third is that of permanganate acid, potassium permanganate or the like. Hence, in the case of aqueous nitrate solution, metallic salt such as metallic salts of nickel, iron, chromium or the like may be used in addition to alkali metal salt and ammonium salt. Although the concentration of aqueous solution is not necessarily be specified, an excessively low level of concentration decreases oxidizing effects. Accordingly, the concentration of aqueous nitric acid solution may be 2% or greater, preferably 5% or greater, and that of the solution of chromic acid or permanganate acid may preferably be 5% or greater.

In order to excite only the surface layer, a pulse laser is suited as a source of laser beam, and a ruby laser, a YAG laser, a glass laser, a $CO_2$ laser or the like are employed in which the large peak value can be obtained by Q-switching and the width of pulse period of time is short. For example, the pulse laser beam preferably has a pulse width of 200 millisec. or less and an energy density of 0.05 Joule or greater, and, as a matter of course, the irradiation of a laser beam may also be repeated in order to obtain a desired surface concentration.

Needless to say, since the surface concentration is increased in proportion to the level of the irradiation energy, a laser beam of a high pulse-repetition frequency is effective if treating the entire surface of a strip which moves at high speed.

Description will be made below of several working examples of the method of improving the functions of the surface of the alloy steel, and alloy steels produced by the method.

WORKING EXAMPLE 1

After the surface of 17 wt% Cr stainless steel (AISI 430) had been polished, it was dipped in aqueous 5% $HNO_3$ solution and the irradiation of a ruby pulse laser ($\lambda=0.695$ $\mu$m) was applied on the stainless steel through a glass window. Regarding the conditions of irradiation, there were adopted the energy level of 1.8 J, the pulse width of $20\times10^{-9}$ sec., and the repeated number of irradiation of 10 times. After the thus-treated steel had been taken out, it was washed and dried, and the composition of the surface was measured by Auger electron spectroscopy. The composition of the outermost layer of the thickness of about 30 Å was 28 at% of Cr, 20 at% of Fe, 51 at% of O and 1 at% of Si in terms of atomic percentage, other elements being not detected because of very small amount. The 28 at% of Cr is equivalent to 58 wt% in terms of weight percentage, and Cr was concentrated on the surface by just over three times in comparison with that of matrix. In consequence, corrosion resistance was remarkably improved, and the depassivation time, which was obtained from variations in electric potential occurring when the steel was dipped in a specified sulfuric acid solution of one normal, was as short as two minutes in the case of no laser treatment (only dipping in the 5% $HNO_3$ solution without the irradiation), but the time became as long as 13 minutes by using a laser treatment. The concentration of chromium in the steel was varied in the same manner as in FIGS. 1A and 1B.

WORKING EXAMPLE 2

After the surface of 7 wt% Cr steel had been polished, it was dipped in aqueous 5% ammonium nitrate solution and a YAG laser ($\lambda=1.06$ $\mu$m) was irradiated on the surface thereof through a glass window. Regarding the conditions of irradiation, the energy level was 0.8J, the pulse width was $15\times10^{-9}$ sec., and the number of repetitions of irradiation was 10 times. After the treated steel had been taken out, it was washed and dried, and the composition of the surface was measured by Auger electron spectroscopy. The chromium on the surface was concentrated by 12% in terms of atomic percentage (25 percent by weight). The corrosion resistance (depassivation time) was 15 sec. in the case where no laser treatment was effected (dipping only), and the resistance was remarkably improved up to 9 minutes in accordance with the treatment of this invention.

WORKING EXAMPLE 3

After the surface of AISI 304 (18%Cr-8%Ni) steel had been polished by emery paper, it was subjected to the same laser treatment as that of Working Example 1. The composition of the surface passive film measured by Auger electron spectroscopy was Cr of 20 at% (equivalent to 41 wt% in a case of a wt%), i.e., Cr was concentrated by just over three times. A test of pitting was carried out by a 10-minute constant current electrolysis method in 0.1 N $FeCl_3$, at 25° C. with 1 mA/cm$^2$, and the corrosion resistance based on the number of caused pittings (measured by a microscope) was remarkably excellent in that the average number was reduced from 15 pittings/$2\times2$ cm$^2$ to 6 pittings/$2\times2$ cm$^2$.

WORKING EXAMPLE 4

After the surface of AISI 304 stainless steel had been polished by emery paper, the same laser treatment as that of Working Example 2 was effected on the steel in aqueous 2% potassium permanganate solution. The number of generated pittings in the solution of 0.1 N $FeCl_3$ was reduced from 15 pittings/$2\times2$ cm$^2$ to 7 pittings/$2\times2$ cm$^2$, thereby remarkably improving the corrosion resistance.

WORKING EXAMPLE 5

After the surface of 17% Cr stainless steel had been polished and dipped in aqueous 5% $CrO_3$ solution, laser treatment was effected under the same conditions as those of Working Example 2. The depassivation time in the solution of 1N—$H_2SO_4$ was remarkably improved up to 8 minutes as compared with 2.5 minutes in the case where no laser treatment was effected.

WORKING EXAMPLE 6

After the surface of AISI 316 (17%Cr-10%Ni-2%Mo) steel had been polished by emery paper, laser treatment was effected in the same manner as that of Working Example 1. The laser treatment caused the concentration of Cr to 27 at% and of Mo to 3 at%. On the other hand, in the case where no laser treatment was effected, no Mo was measured on the surface. According to a test on pitting, the number of pittings was reduced to $0/2\times0$ cm$^2$ from 3 pittings/$2\times2$ cm$^2$ which was the value obtained when no laser treatment was effected, thereby achieving a remarkable improvement of the corrosion resistance.

Description will be then made below regarding working examples of a structure having an improved surface function embodying the invention.

WORKING EXAMPLE 7

Figure 9:
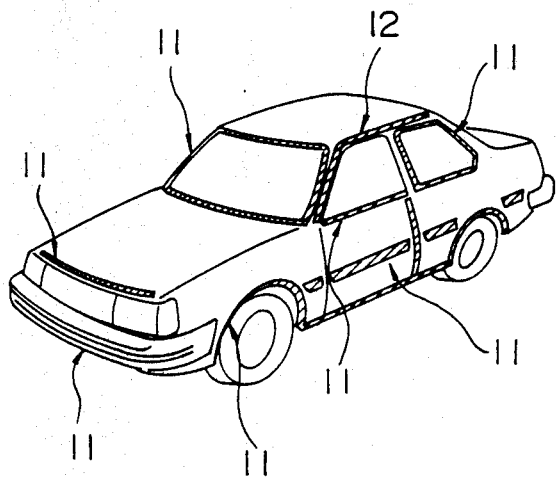
FIG. 9 is a perspective view of an automobile in which moulding parts 11 and 12 are fixed which are one of a structure embodying the invention.
Figure 10:
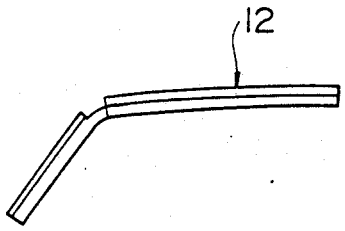
FIG. 10 is an enlarged perspective view of the moulding part 12 shown in FIG. 9.

Mouldings 11 and 12 shown in FIGS. 9 and 10 for an automobile were produced from a AISI 430 stainless steel having been treated by the same method as in the working example 1 by use of a conventional press machine. FIG. 10 shows a roof drip moulding 12, while FIG. 9 shows other mouldings 11 fitted in the automobile. The mouldings were exposed to the marine atmospheric air at a height of 30 cm and at a distance of 5 m from a seashore so as to evaluate the degree of occurrence of rust by the naked eye. As a result, there was clearly cuased red rust of 10% in area after the elapse of one month in the case of mouldings unirradiated with laser beam, while no rust was caused in the mouldings 11 and 12 irradiated with laser beam.

WORKING EXAMPLE 8

Figure 11:
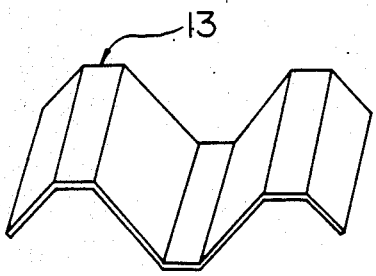
FIG. 11 is a perspective view of a roofing which is one of the structure of the invention.

AISI 430 stainless steel sheet of 0.6 mm in thickness was subjected to scotch bright treatment and then subjected to a laser beam irradiation in a 5% $HNO_3$ with laser beam of 3 mm in diameters regarding the whole surface thereof. After a epoxy resin layer of 5 μm and a fluorine-containing resin of 20 μm were applied on the surface thereof, the sheet was worked to a roofing 13 shown in FIG. 11. The roofing 13 was scratched with knife on a flat portion thereof, which roofing was then exposed to the outdoor atmosphere in an industrial area. Although in a AISI 430 comparison roofing produced in the same manner as above but without the irradiation of the laser beam there was caused red rust after the elapse of two month, in the roofing of the invention there was caused no rust even after the elapse of one year.

WORKING EXAMPLE 9

Figure 12:
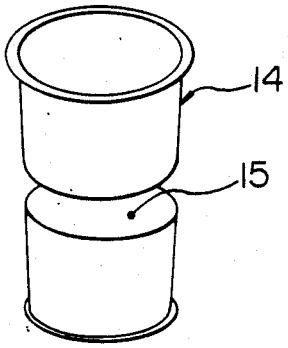
FIG. 12 is a perspective view of a can partly taken away which is one of the structure of the invention.

3% Cr containing alloy steel sheet of 0.23 mm in thickness was irradiated in a 3% $HNO_3$ aqueous solution with YAG laser beam with 8 mm in diameter and with 3 mm in interval with respect to a square of 30 cm in one side. By use of the irradiated sheet was produced a can body 14 shown in FIG. 12 in such a manner that the irradiated surface of the sheet becomes the inner face of the resultant can body. According to the AES measurement, the concentration of Cr in the surface thereof was about 10 wt%. The resultant can body 14 having no coating was filled with 1.5% NaCl and 1.5% citric acid-containing aqueous solution. After the elapse of a half year the amount of iron pick-up in the solution was 0.1 ppm, while in a case of a comparison can body produced without the irradiation of laser beam the amount of iron pick-up in a solution was 15 ppm. Thus, the can body of the invention was superior to a conventional one.

Figure 4:
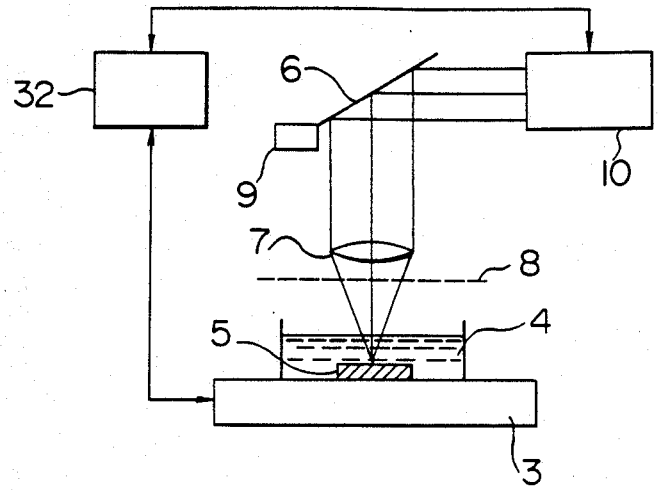
FIG. 4 is a schematic view showing a method of the invention for improving a function of a surface by providing a color pattern on an alloy steel.

Description will be made below of a method of the invention for producing a color-pattern sheet by using a laser beam, the system used in which method is schematically shown in FIG. 4.

Figure 5:
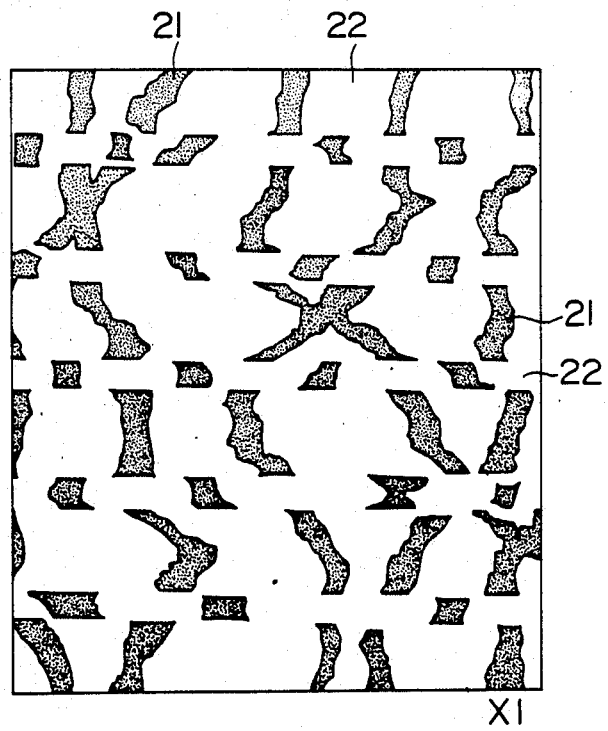
FIG. 5 is a plan view of one example of the screen which is used in the method of producing a colorpattern sheet of the present invention.

FIG. 5 shows one example of a mask used in the method, reference numeral 21 denoting openings and reference numeral 22 denoting intercepting portions. The mask 8 may be made of aluminium, stainless steel foil, a thin sheet or any other material which can intercept light. The mask can be disposed at a given position in the optical path of a laser beam between the output end of a laser device 10 and the surface of the alloy steel. Therefore, the mask may be disposed in close contact with the alloy metal either in the interior of or the exterior of a solution used in the method. Reference numeral 6 is a mirror used in the method, 7 being a lens, 9 being a mirror moving unit, 3 being a stage moving in X-Y directions, and 32 being an operation unit.

When an irradiation of laser beam is applied on a chromium-containing steel which is kept in contact with the aqueous solution of oxidizing acid or salt thereof, chromium is concentrated on the surface. This mechanism and the conditions are the same as those described above with reference to FIG. 1A.

The mask is composed of a planar sheet material which has the small transmissivity of a laser beam, and openings of a desired pattern to be transferred which openings are punched in the material. A thin sheet of aluminium or the like is suitable, and white paper may also be used. The size of the punched pattern is preferably the same as that of a desired pattern to be transferred onto the sheet, but in a case where a laser beam is converged or diverged by a lens or a curved mirror, the pattern formed on the mask can be reduced or enlarged so as to be transferred onto the mask. The irradiation of a laser beam can also be performed in such a manner that a gradational polychrome pattern is obtained by the diffraction of the laser beam or the like, in accordance with each method of irradiation or each position of the mask. Furthermore, if the mask is moved or is replaced with another mask having a different pattern during the irradiation of a laser beam, at least two patterns having mutually different levels of the concentration of chromium can be transferred onto the surface of sheet.

A method of effecting oxidation treatment for the purpose of coloring is to separately color the portion in which chromium is concentrated by the irradiation of a laser beam and the portion which is not irradiated with a laser beam due to the interception of the beam. Various methods are available with respect to the coloring of chromium-containing steel, but since the above-described portion where chromium is concentrated is thin, it is necessary to select such a suitable coloring method as the influence of the concentration of chromium is maintained. It is well known that, when a chromium-containing steel is heated, the steel is colored to have an interference color in accordance with the thickness of the oxide film. The inventors applied an irradiation of a laser beam through the mask on the surface of 17% chromium stainless steel so as to provide a pattern-formed chromium-concentrated portion. Then, the sheet was heated at about 700° C. in the atmosphere for three minutes. As shown in Working Example 10, the chromium-concentrated portion was colored purplish red while the unirradiated portion was colored blue, thereby successfully obtaining a beautiful polychrome-pattern sheet. This phenomenon shows that the oxide film which is produced when heating the steel in the atmosphere is formed more slowly on the chromium-concentrated portion which is irradiated with a laser beam than on the unirradiated portion. Furthermore, it was found that the combination of the colors of the irradiated and unirradiated portions could be changed by varying heating period of time and temperatures, thereby obtaining a variety of polychrome-pattern sheets. Working Example 11 shows another method of effecting oxidation treatment for the purpose of coloring. It is well known that, when AISI 304 (18%Cr-8%Ni stainless steel) steel is dipped at about 750° C. in an aqueous solution containing $CrO_3$ and $H_2SO_4$ as the major components, a film containing chromium is formed on the surface of the sheet and the film becomes thick with the elapse of dipping time, the film being colored to have a various interference colors in accordance with the thickness thereof. The inventors dipped the specimen which had been irradiated with the laser beam of this invention, at 75° C. in an aqueous solution containing 250 g/l of $CrO_3$ and 500 g/l of $H_2SO_4$ for ten minutes. It was found that the chromium-concentrated portion was colored to have gold while the unirradiated portion was colored to have green, thereby successfully obtaining a polychrome pattern sheet. In this method as well, various combinations of colors can be achieved by varying dipping time and temperatures.

Description will be made below of Working Examples relating to the method of improving the surface function of an alloy steel by producing a color-pattern on the alloy steel sheet, and an alloy steel sheet having colored pattern formed by the method of the present invention.

WORKING EXAMPLE 10

After the surface of AISI 430 stainless steel had been polished by a diamond paste (3 μm) and degreased, it was dipped in an aqueous 3% $HNO_3$ solution, an irradiation of a YAG laser beam (1J/pulse, 2 pulses) being applied on the sheet through a mask having star-shaped holes of 5 mm in size. The irradiated specimen was washed and dried, being heated at 700° C. in an electric furnace for three minutes, and being then cooled. An oxide film was formed on the surface of the specimen and the specimen was colored to have a purplish red due to interference. The portions which had been irradiated with a laser beam in a star-shaped form were colored to have a light blue and a vividly colored pattern was brought into relief.

WORKING EXAMPLE 11

Figure 6:
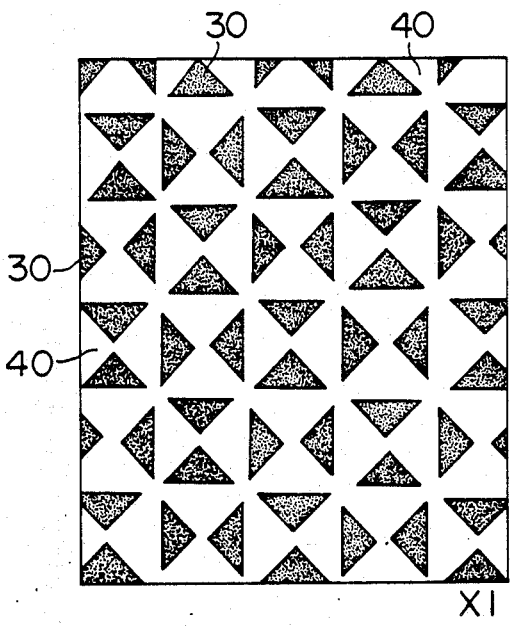
FIG. 6 is an illustration of one example of the color-pattern sheet which is produced by the method of the present invention.

After AISI 304 bright annealed stainless steel sheet had been degreased and dipped in an aqueous 5% $HNO_3$ solution, an irradiation of a ruby laser beam (2.2J/pulse, 1 pulse) was applied on the sheet through the mask in which triangular pattern openings each having a bottom side of 12 mm and a height of 6 mm were provided. The irradiated specimen was dipped at 75° C. in an aqueous solution of 250 g/l of $CrO_3$ and 500 g/l of $H_2SO_4$ for ten minutes. The unirradiated portions were colored green and the irradiated portions were colored gold. FIG. 6 shows the result in which a white portion 40 is colored green and the remaining black portions 30 are colored gold.

WORKING EXAMPLE 12

After AISI 410 stainless steel had been polished by emery paper No. 600 and a mask having a punched-alphabet pattern had been stuck to the steel, an irradiation of a YAG laser beam (0.8J/pulse, 5 pulses) was applied on the steel in an aqueous 1% potassium permanganate solution and was dipped in the same solution as that of Working Example 11 for seven minutes. The unirradiated portions were colored dark blue and the irradiated portion remained a gloss of metal in color.

WORKING EXAMPLE 13

After AISI 304 stainless steel had been degreased and dipped in the mixture of the solutions of 1% chromic acid and 1% ammonium chromate, an irradiation of a ruby laser beam was applied on the steel through the mask having the punched pattern shown in FIG. 5 and was colored under the same conditions as those of Working Example 11. The irradiated portions were colored green and the unirradiated portions were colored purple.

Methods have heretofore been known in which chromium-containing steel is colored by forming an interference film on the surface through an oxidation process or the like. However, although the entire surface of the sheet can be monochromatically colored, it has been difficult to form a polychrome pattern on the surface in the case of prior art. The method of producing a color-pattern sheet of the present invention successfully solves the problem, and it becomes possible to color a desired pattern in desired color, thereby impart ornamentality to chromium-containing steel and greatly enlarging the applicability thereof.

Description will be made below regarding another method of improving surface function of alloy steel of the invention by providing a color pattern thereon with precise control of both the pattern and color tone, and an alloy steel having color patterns formed by the method.

Figure 7:
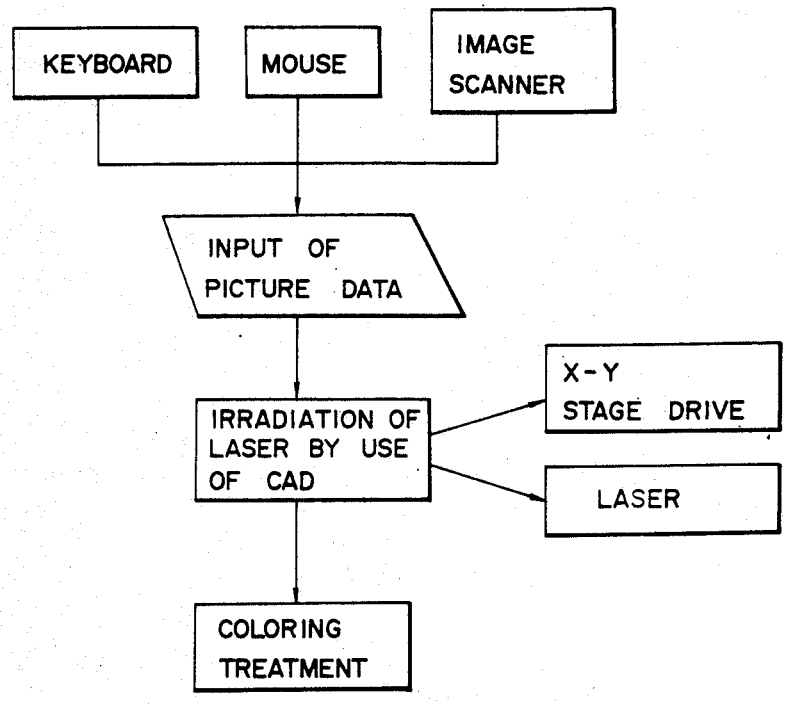
FIG. 7 is a flow chart of the process of the invention in which there is used computer-controlled irradiation of a laser beam which is one of the methods of producing a color-pattern sheet.

Referring to FIG. 7 showing a flow chart of this method, the irradiation of a laser beam is controlled by a computer. The data on an image to be depicted on an alloy steel is input to a computer by a key board, mouse, image scanner or the like. Such continuous image data are divided in accordance with the area of the irradiation of a laser beam, and is converted into an picture image which can be irradiated on the surface. At this time, the irradiation power of a laser beam is appropriately selected in accordance with a desired color, light and shade. Specifically, when the irradiated portion needs to be made different from the unirradiated portion in color, the irradiation power of a laser beam is increased. Conversely, when the color difference needs to be reduced, the irradiation power of a laser beam is decreased. When using a continuously oscillated laser beam, the irradiation power of a laser beam is controlled by controlling a period of time required for the irradiating of the beam on each portion, and when using a pulse laser beam, the irradiation power is controlled by controlling the number of repeated irradiation pulses or the energy of the beam. Usually, a sectional form and area of the irradiation beam applied on the irradiated surface are made to be the same as those of an incident laser beam, but such form and area are selected so as to suit the picture image to be depicted on the surface of the alloy steel. When the irradiation of a laser beam is to be controlled by use of a computer 2, the sectional shape and area of the laser beam is selected to suite the picture image which is depicted on the surface of the alloy steel. The shape and size of the respective picture elements of the picture image which is actually depicted are determined in correspondence with such selection. Subsequently, the light and shade of the respective picture elements of the original pattern are read out by the key board, the mouse, and the image scanner shown in FIG. 7 and are input to the computer in the form of image data. On the basis of the image data, a CAD laser beam irradiation system causes the movement of an X - Y stage or controls the irradiation power of laser beam, whereby the irradiation power of a laser beam corresponding to the light and shade of the respective picture elements of the original pattern is applied on the surface of the alloy steel corresponding to the position of the respective picture elements of the original pattern, and the surface to be irradiated is caused to travel toward the desired position of irradiation.

A method of separately coloring the chromiumconcentrated portion which was subjected to the irradiation of a laser beam and the portion which is not irradiated with the laser beam is the same as Working Examples 10–13 described above in connection with the method of the present invention, and the conditions of irradiation of a laser beam are also the same as those of such Working Examples.

Figure 8:
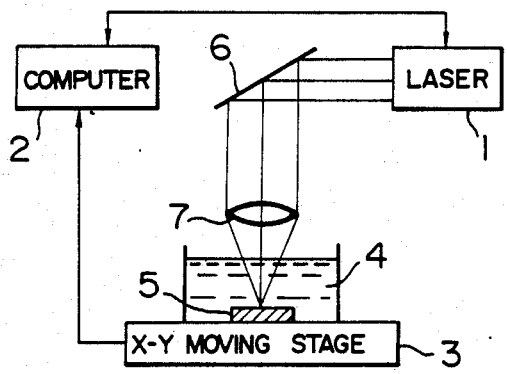
FIG. 8 is a schematic illustration of the system of the computer-controlled irradiation of a laser beam, modifying the case of FIG. 4.

FIG. 8 shows a system of controlling the irradiation of a laser beam by using a computer. FIG. 8 further shows an example in which alloy steel 5 is placed in an aqueous solution of oxidizing acid or salt thereof disposed on an X - Y stage 3, and is caused to travel under the control of a computer 2, thereby effecting the irradiation of a laser beam. Instead of moving the sheet, the positions to and the directions in which a mirror group 6 and a lens group 7 travel are controlled by the computer 2, so that it is also possible to move the portion on which an irradiation of a laser beam is applied. The laser beam to be applied can also be formed in a desired sectional shape by an optical method using a telescope lens. When the intensity distribution of a laser beam is symmetrical with respect to the optical axis, the sectional shape of the beam approaches a true circle. Therefore, for example, when using a laser beam of a square sectional shape, if the beam is caused to pass through the square slit, it is also possible to obtain a beam having a square sectional shape and a uniform intensity distribution. In order to vary the sectional shape of the laser beam as desired, the convergence of the laser beam is adjusted by varying the position of the lens or the like or by replacing the lens group with another kind of lens group. As described above, the sectional shape and size of the laser beam which is used for irradiation can be varied as desired by moving the mirror or lens or by selecting an appropriate slit out of a plurality of groups of slits different in shape. Data on these movement and selection is stored in advance in the CAD laser beam irradiation system so as to be easily reproduced for such a control operation.

Description will be made below with reference to Working Examples 11 to 14.

WORKING EXAMPLE 14

The code in chinese characters was input to the computer through the key board thereof and was converted into data on picture images. Based on the data, an irradiation of computer-controlled pulse YAG laser beam was applied in the form of a spot of 5 mm square on the surface of an AISI 304 stainless steel sheet which was dipped in an aqueous 5% nitric acid solution. After the sheet had been irradiated with the laser beam, it was colored at 75° C. in an aqueous solution containing 250 g/l of chromic acid and 500 g/l of sulfuric acid for ten minutes. By this coloring, the chinese characters could be depicted vividly on the surface of the sheet 30 cm square.

WORKING EXAMPLE 15

Graphic design was input to the computer through the mouse thereof which is an input unit for a computer. Based on the input data, an irradiation of computer-controlled pulse YAG laser beam was applied in the form of a spot 2 mm square on the surface of an AISI 304 stainless steel sheet which was dipped in an aqueous 2% chromic acid solution. Color was varied by controlling the number of irradiation pulses. The irradiated specimen was colored in the same manner as that of Working Example 14, thereby successfully obtaining a vivid color-pattern sheet.

WORKING EXAMPLE 16

The graphic design which had been depicted on paper was input to the computer by image scanner which is a graphic pattern input unit for a computer thereof, and a color-pattern sheet was produced in the same manner as that of Working Example 15.

WORKING EXAMPLE 17

Graphic design was input to the computer by the mouse thereof which is an input unit for a computer. Based on the design data, an irradiation of a continuous YAG laser beam was applied in the forme of a spot of 5 mm square on the 13% Cr alloy steel sheet which was dipped in an aqueous 1% potassium permanganate. The irradiation period of time of the respective beam spots was 0.1 sec. The thus-irradiated sheet was heated at 800° C. in the atmosphere for one minute and a desired oxide film was formed, thereby forming a color-pattern sheet.

As will be readily understood from the foregoing, although the prior-art technique of coloring the surface of a sheet has relied upon the method in which the entire surface is monochromatically colored, the method of the present invention has succeeded in separately coloring the surface of the sheet. Furthermore, in accordance with this method of the present invention, a pattern can easily be drawn on the surface by a laser beam because it is unnecessary to use any slit shaped in the form of a pattern (mask). In addition, since the present invention is arranged such that the size and the irradiation power of a lase beam is controlled by a computer, it is possible to easily produce the color-pattern sheet having a fine chart, a variety of hues and delicate difference in color tone.

While the above provides a full and complete disclosure of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A method of improving surfaced function of a chromium containing alloy steel, comprising the steps of:

providing a chromium containing alloy steel having a surface, providing an aqueous solution of an oxidizing acid or of salt of said acid so that the solution is in contact with the surface of the alloy steel, irradiating the surface of the alloy steel with laser beams through said aqueous solution so that at least the chromium constituent of the alloy steel is concentrated in at least a part of said surface.

2. A method as claimed in claim 1, wherein said aqueous solution contains at least one kind selected from the group consisting of nitric acid, a nitrate, chromic acid, a chromate, permanganic acid, and a permanganate.

3. A method as claimed in claim 1, wherein said alloy steel is one selected from the group consisting of a ferritic stainless steel, an austinitic stainless steel, and a low alloy steel containing chromium of not more than 13 weight %.

4. A method for improving the surface function of an alloy steel by providing a color-pattern, comprising the steps of:

providing a chromium containing alloy steel having a surface in contact with an aqueous solution of an oxidizing acid or salt thereof;

irradiating the surface of the alloy steel with a laser beam through a mask to concentrate the chromium in the irradiated surface and so that both an irradiated portion and an unirradiated portion are provided on said surface; and subjecting the surface of the alloy steel to a coloring so that said irradiated portion has a color different from that of said unirradiated portion.

5. A method as claimed in claim 4, wherein said aqueous solution contains at least one kind selected from the group consisting of nitric acid, a nitrate, chromic acid, a chromate, permanganic acid, and a permanganate.

6. A method as claimed in claim 4, wherein said alloy steel is one selected from the group consisting of a ferritic stainless steel, an austinitic stainless steel, and a low alloy steel containing chromium of not more that 13 weight %.

7. A method as claimed in claim 4, wherein the difference of the colors between the portion irradiated with the laser beam and the unirradiated portion occurs due to the difference of the concentration of chromium therein.

8. A method of the invention for improving the surface function of an alloy steel by a color pattern with precise control of the pattern and color tone thereof, comprising the steps of:

providing a chromium containing alloy steel having a surface in contact with an aqueous solution of an oxidative acid or salt thereof;

irradiating the surface with a laser beam so as to concentrate chromium in the irradiated surface while controlling an irradiation pattern, dimensions, a position of irradiation and amount of irradiation by use of a computer so that irradiation power of laser beam varies in the pattern; and subjecting the irradiated surface to an coloring so that said irradiated portion has polychrome pattern due to the variation in chromium concentration.

9. A method as claimed in claim 8, wherein said aqueous solution contains at least one kind selected from the group consisting of nitric acid, a nitrate, chromic acid, a chromate, permanganic acid, and a permanganate.

10. A method as claimed in claim 8, wherein said alloy steel is one selected from the group consisting of a ferritic stainless steel, and austinitic stainless steel, and a low alloy steel containing chromium of not more that 13 weight %.

* * * * *